US008689412B2

(12) United States Patent
Grover

(10) Patent No.: US 8,689,412 B2
(45) Date of Patent: Apr. 8, 2014

(54) MEMORIAL CARRIER

(71) Applicant: Dawson R. Grover, Coon Rapids, MN (US)

(72) Inventor: Dawson R. Grover, Coon Rapids, MN (US)

( * ) Notice: Subject to any disclaimer, the term of this patent is extended or adjusted under 35 U.S.C. 154(b) by 0 days.

(21) Appl. No.: 13/649,851

(22) Filed: Oct. 11, 2012

(65) Prior Publication Data

US 2013/0086780 A1 Apr. 11, 2013

Related U.S. Application Data

(60) Provisional application No. 61/545,862, filed on Oct. 11, 2012.

(51) Int. Cl.
*A61G 17/00* (2006.01)

(52) U.S. Cl.
USPC ..... 27/27; 27/1; 211/85.16; 211/85.27; 108/50.11

(58) Field of Classification Search
USPC ..... 27/1, 27; 211/85.16, 85.27; 296/16, 18; 108/143, 50.01, 50.02, 25, 26, 50.11, 108/90, 44
See application file for complete search history.

(56) References Cited

U.S. PATENT DOCUMENTS

| | | | | |
|---|---|---|---|---|
| 6,421,890 | B1 * | 7/2002 | Biggar | 27/1 |
| 6,513,352 | B1 * | 2/2003 | Mainville | 70/166 |
| 7,043,803 | B2 * | 5/2006 | Chen | 27/1 |
| 7,191,498 | B2 * | 3/2007 | Fischer | 27/1 |
| 7,373,702 | B1 * | 5/2008 | Vonderheide | 27/1 |
| 7,565,869 | B2 * | 7/2009 | Daniel | 108/102 |
| 7,621,575 | B1 * | 11/2009 | Kellerman | 296/16 |
| 8,083,275 | B2 * | 12/2011 | Myhre et al. | 294/16 |
| 8,256,356 | B2 * | 9/2012 | Fremming | 108/50.02 |
| 8,424,472 | B2 * | 4/2013 | Fremming | 108/143 |
| 2003/0088954 | A1 * | 5/2003 | Mainville | 27/1 |
| 2005/0204524 | A1 | 9/2005 | Morris | |
| 2009/0178594 | A1 * | 7/2009 | Fremming | 108/50.11 |

OTHER PUBLICATIONS

U.S. Appl. No. 29/403,808, filed Oct. 11, 2011, entitled "Memorial Carrier," Dawson R. Grover.

* cited by examiner

*Primary Examiner* — William Miller
(74) *Attorney, Agent, or Firm* — Shumaker & Sieffert, P.A.

(57) ABSTRACT

An apparatus including a mounting platform, wherein the mounting platform includes a substantially planar mounting surface; a clamping mechanism on the mounting surface; a memorial item retained by the clamping mechanism; and an arrangement of handles on a side of the mounting platform, wherein the side is substantially normal to the plane of the mounting surface.

8 Claims, 3 Drawing Sheets

MEMORIAL CARRIER

This application claims the benefit of U.S. Provisional Application No. 61/545,862, filed Oct. 11, 2011, which is hereby incorporated by reference in its entirety.

TECHNICAL FIELD

This disclosure relates to an apparatus for carrying or transporting a memorial item such as, for example, a crematory urn, a casket, a picture frame or a flag case.

BACKGROUND

Urn arks or other memorial carriers can be used to display a cremation urn, and some carriers have poles so the carrier can be moved by pall bearers during a funeral ceremony.

SUMMARY

Cremation urn arks, as well as infant and toddler caskets, are difficult to transport with a standard funeral trolley (church cart), and are difficult to lock securely into the cargo bay of a standard hearse. A multifunctional/multipurpose memorial carrier is needed that can easily be used to securely transport any type and/or size of cremation urn (round, oval, rectangular, square), infant caskets, toddler caskets, flag cases and the like.

In general, this disclosure is directed to an apparatus including a mounting platform, wherein the mounting platform includes a substantially planar mounting surface; a clamping mechanism on the mounting surface; a memorial item retained by the clamping mechanism; and an arrangement of handles on a side of the mounting platform, wherein the side is substantially normal to the plane of the mounting surface.

In another embodiment, this disclosure is directed to a method of transporting a memorial item, including securing the memorial item in a clamping mechanism on a substantially planar mounting surface of a mounting platform, wherein the mounting platform includes a substantially rectangular body; and wherein the clamping mechanism includes an arrangement of apertures in the mounting surface, and at least one bier pin insertable in the apertures, and wherein the bier pin includes an adjustable clamp; and securing the mounting platform on a wheeled dolly or in a hearse cargo bay.

In yet another embodiment, this disclosure is directed to a hearse including a cargo bay, wherein the cargo bay includes a first clamping mechanism; a mounting platform secured in the first clamping mechanism of the cargo bay, wherein the mounting platform includes a substantially rectangular body, and wherein the mounting platform includes a substantially planar mounting surface; a second clamping mechanism on the mounting surface; wherein the second clamping mechanism includes an arrangement of apertures in the mounting surface, and at least one bier pin insertable in the apertures, and wherein the bier pin includes an adjustable clamp; and a memorial item retained by the second clamping mechanism on the mounting surface.

In yet another embodiment, this disclosure is directed to a funeral cart, including a casket mounting surface, wherein the casket mounting surface includes a wheeled dolly; a mounting platform on the casket mounting surface, wherein the mounting platform includes a substantially rectangular body, and wherein the mounting platform includes a substantially planar memorial item mounting surface; a clamping mechanism on the memorial item mounting surface; wherein the clamping mechanism includes an arrangement of apertures in the mounting surface, and at least one bier pin insertable in the apertures, and wherein the bier pin includes an adjustable clamp; a memorial item retained by the clamping mechanism on the mounting surface; and an arrangement of handles on a side of the mounting platform, wherein the side is substantially normal to the plane of the mounting surface.

The memorial carrier makes possible the secure transport of memorial items of any size and shape via a hearse or funeral trolley, which makes possible a traditional funeral processional and pall bearers. The memorial carrier is particularly useful for transport of crematory urns and infant or toddler caskets, which have heretofore been difficult to securely display or transport. The memorial carrier may easily be secured inside the hearse with the standard cargo bay bier pins which normally secure an adult casket. The beautiful ornamental design of the memorial carrier allows for a processional, front display table viewing of the memorial item, recessional, and pall bearers. The memorial carrier provides a comforting option to families who have lost an infant or toddler. Rather than having a family member or two carry the small casket, it can be beautifully displayed on the memorial carrier with flowers and/or pictures and can be moved easily on a funeral trolley.

The details of one or more embodiments of the invention are set forth in the accompanying drawings and the description below. Other features, objects, and advantages of the invention will be apparent from the description and drawings, and from the claims.

BRIEF DESCRIPTION OF DRAWINGS

Like symbols in the drawings indicate like elements.

DETAILED DESCRIPTION

Figure 1:
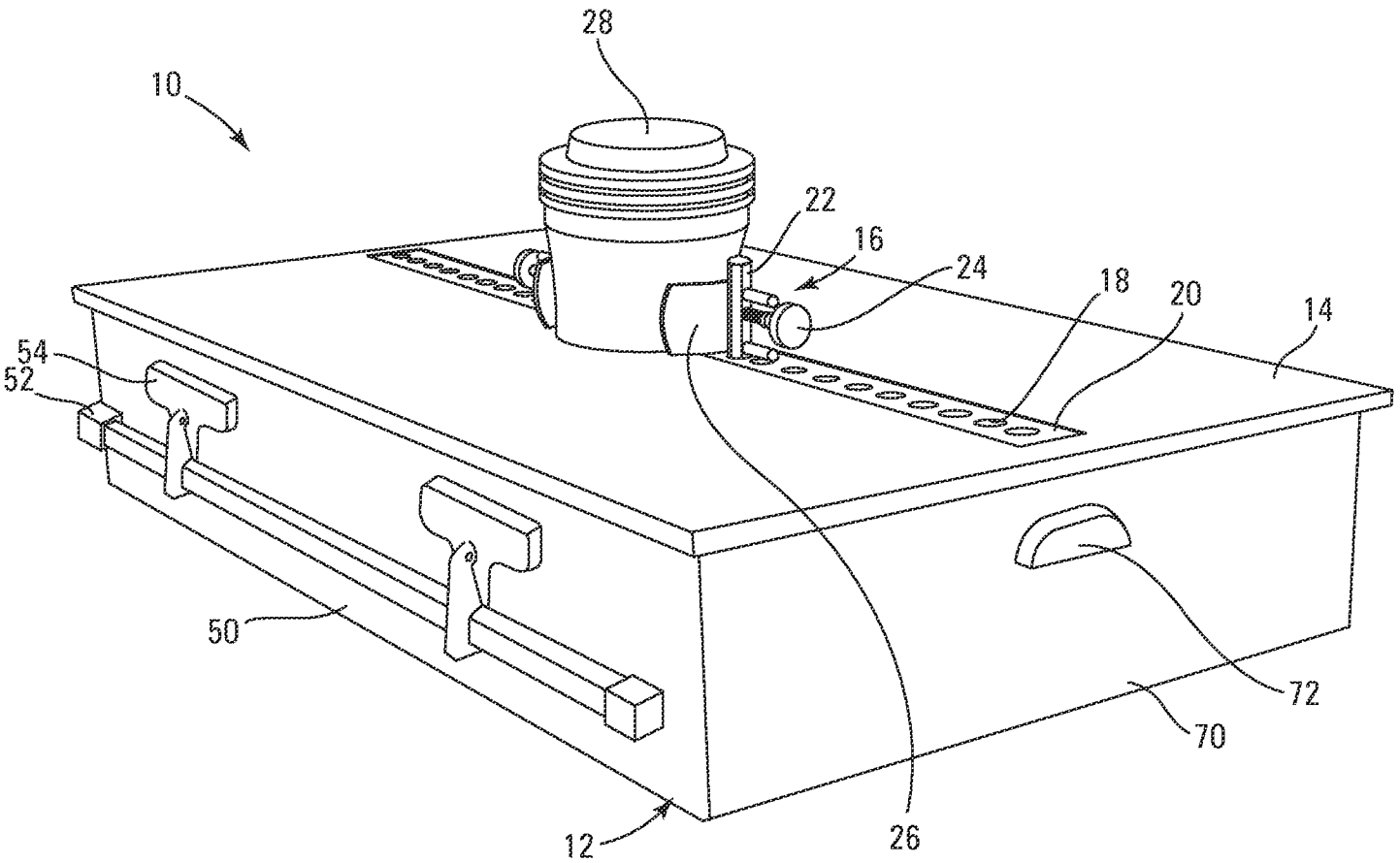
FIG. 1 is a perspective view of an embodiment of a memorial carrier.

Referring to FIG. 1, a memorial carrier 10 includes a mounting platform 12. The shape of the mounting platform 12 may vary widely depending on the size and shape of the memorial item to be transported, and in this embodiment is a substantially rectangular hollow body. The hollow body may be constructed of a wide variety of materials, but wood has been found to be useful for its light weight, ease of machining, and highly decorative exterior surface finish.

The mounting platform 12 includes a substantially planar mounting surface 14. The mounting surface 14 may optionally be hinged to move upward and permit access to the interior of the mounting platform 12 for storage of small items. The mounting surface 14 has attached thereto a clamping mechanism 16. Again, the clamping mechanism 16 may vary widely depending on the memorial item to be retained therein, but in this embodiment the clamping mechanism 16 includes an arrangement of apertures 18 in the mounting surface 14, and a bier pin support plate 20 having a corresponding array of apertures. The number of apertures 18 in the mounting surface 14 and the bier pin support plate 20 may vary widely depending on the size and shape of the memorial item to be retained.

The clamping mechanism 16 further includes at least one bier pin 22, which is retained in the bier pin support plate 20 in a position generally normal to a plane of the mounting surface 14. The bier pin 22 includes an adjustable clamp 24 with a clamp plate 26. The shape of the clamp plate 26 may vary widely to securely retain a memorial item 28, in this embodiment a crematory urn. Additional memorial items that can be retained by the clamping mechanism 16 include, but are not limited to, caskets (particularly infant and toddler sized caskets), picture frames, and memorial flag cases. The memorial item to be retained may have any desired shape, including, but not limited to, round, oval, rectangular, and square.

Figure 2:
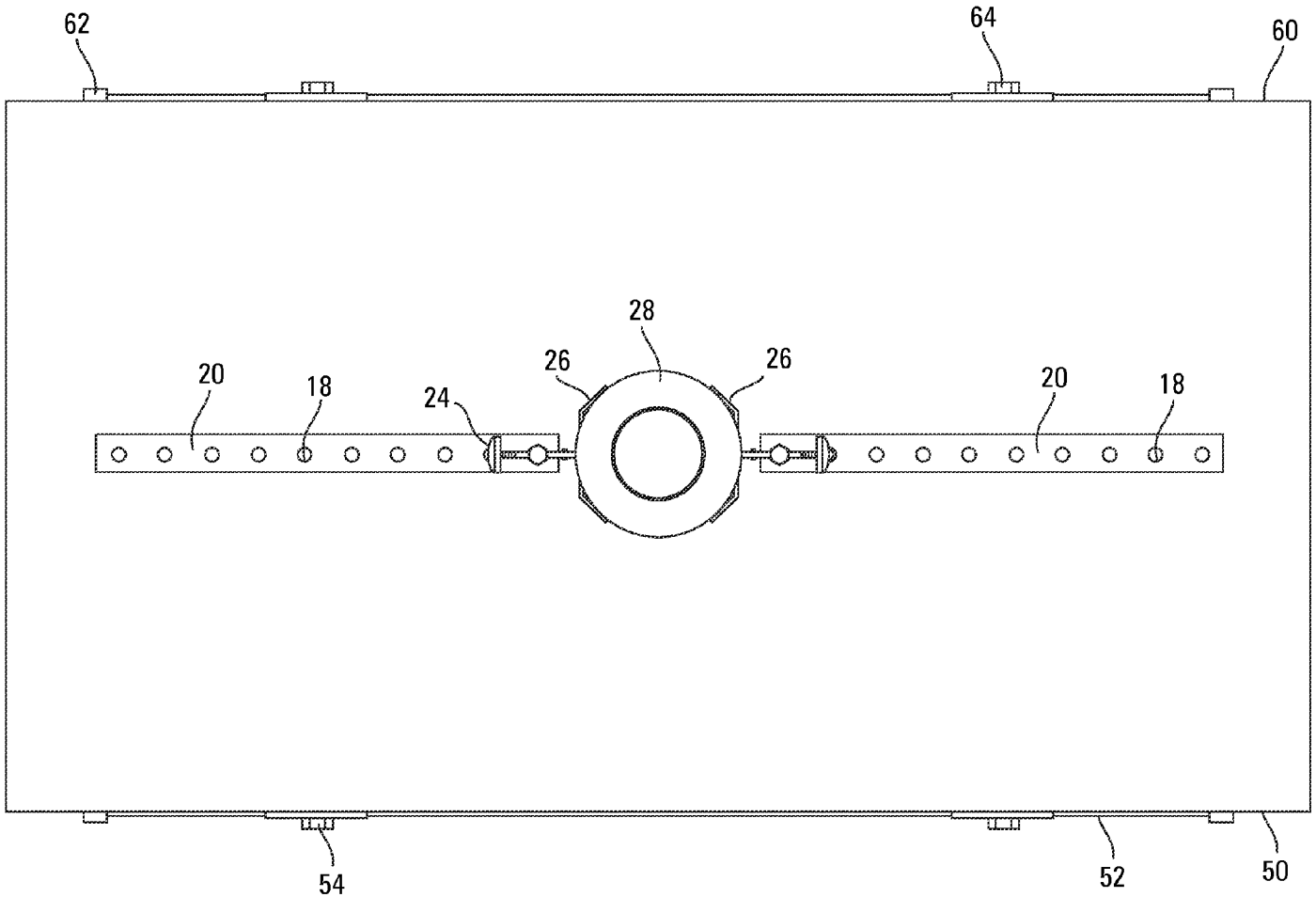
FIG. 2 is a top view of an embodiment of the memorial carrier.
Figure 3:
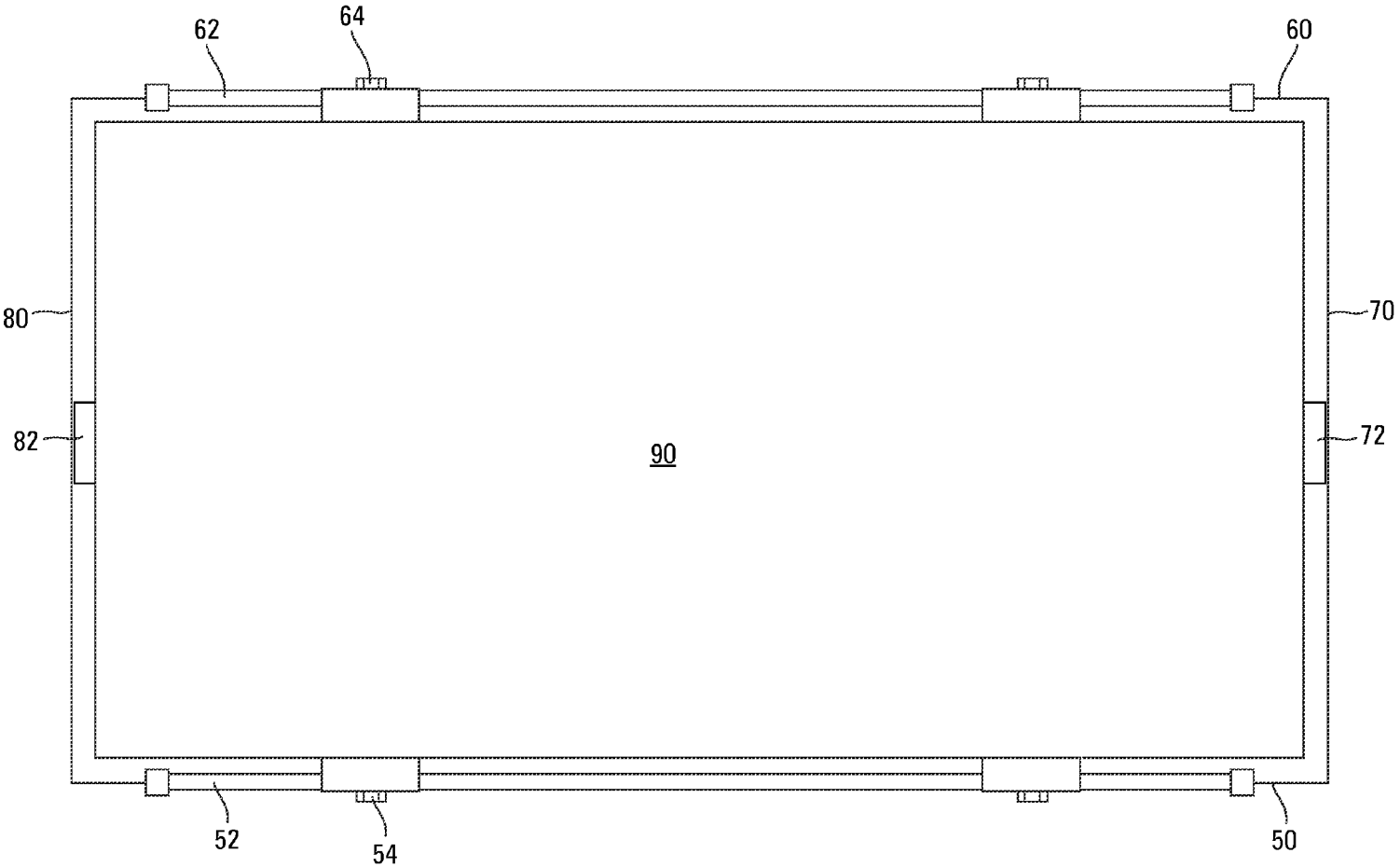
FIG. 3 is a bottom view of an embodiment of the memorial carrier.

The mounting platform 12 further includes a first side 50 that is generally normal to the plane of the mounting surface 14. The first side 50 includes an elongate carrying handle 52 to allow pall bearers and funeral home personnel to transport the mounting platform 12 from hearse to graveside, or to easily place the mounting platform 12 on a wheeled dolly (funeral trolley or church cart) for use in a funeral ceremony. The handle design may vary widely, and in this embodiment includes decorative mounting hardware 54 to allow the handle 52 to swing out and away from the side 50 for ease of handling. A second opposed side 60 of the mounting platform 12 may include similar handles 62 and mounting hardware 64 (FIGS. 2-3).

A third side 70 of the mounting platform 12 includes a grab handle 72 to allow funeral home personnel to easily remove the mounting platform from a cargo bay of a funeral vehicle (hearse). An opposed fourth side 80 of the mounting platform 12 includes a similar grab handle 82 (FIG. 3).

In use, after the memorial item 28 is clamped into position on the mounting surface 14 of the memorial carrier 10 using the adjustable clamps 24, funeral home personnel may grasp the handles 52, 62 and transport the mounting platform 12 without concern that the memorial item 28 will fall from the mounting platform 12 and sustain damage. The underside 90 (FIG. 3) of the mounting platform 12 may then be placed on a wheeled dolly such as a church cart and moved into position for a funeral service. Following the funeral service, the mounting platform 12 may be removed from the church cart, transported to the hearse, and placed in the hearse cargo bay. The hearse cargo bay includes an arrangement of bier pins, which may be used to securely clamp the mounting platform 12 into position during transport to the grave site. For example, the bier pins in the hearse cargo bay may engage the opposed sides 50, 60 or 70, 80 of the mounting platform 12 to securely lock the mounting platform into position. Once the hearse reaches the grave site, the funeral home personnel may release the hearse cargo bay bier pins, grasp the grab handles 72, 82, and remove the mounting platform 12 from the hearse. The mounting platform 12 may then be carried by the handles 52, 62 and placed in position for the funeral ceremony. The memorial item 28 may then be released by loosening the adjustable clamps 24.

Various embodiments of the invention have been described. These and other embodiments are within the scope of the following claims.

The invention claimed is:

1. An apparatus, comprising:

a mounting platform, wherein the mounting platform comprises a substantially planar mounting surface;

a bier pin mounting plate on the mounting surface, wherein the bier pin mounting plate comprises an arrangement of apertures cooperating with an arrangement of apertures in the mounting surface;

a clamping mechanism on the mounting surface, wherein the clamping mechanism comprises least one bier pin insertable in the apertures in the bier pin mounting plate and the apertures in the mounting surface;

a memorial item retained by the clamping mechanism; and an arrangement of handles on opposed first and second sides of the mounting platform, wherein the opposed first and second sides are substantially normal to the plane of the mounting surface.

2. The apparatus of claim 1, wherein the mounting platform is a substantially rectangular body.

3. The apparatus of claim 1, wherein the bier pin comprises a clamp.

4. The apparatus of claim 3, wherein the clamp is adjustable.

5. The apparatus of claim 1, wherein the arrangement of handles comprises a first elongate handle on the first side of the mounting platform, and a second elongate handle on the second side of the mounting platform.

6. The apparatus of claim 5, wherein the arrangement of handles further comprises a first grab handle on a third side of the mounting platform, wherein the third side is substantially normal to the first side and the second side and substantially normal to the plane of the mounting surface, and a second grab handle on a fourth side, wherein the fourth side is opposite the third side and substantially normal to the first side and the second side and the plane of the mounting surface.

7. The apparatus of claim 1, wherein the memorial item is at least one of a crematory urn, a casket, a picture frame and a flag case.

8. A method of transporting a memorial item, comprising:

placing the memorial item on a mounting platform, wherein the mounting platform comprises a substantially planar mounting surface and a bier pin mounting plate on the mounting surface, wherein the bier pin mounting plate comprises an arrangement of apertures cooperating with an arrangement of apertures in the mounting surface; and a clamping mechanism on the mounting surface, wherein the clamping mechanism comprises two bier pins insertable in the apertures in the bier pin mounting plate and the apertures in the mounting surface, and wherein the bier pins comprise clamps; and securing the memorial item in the clamps.

* * * * *